US005458038A

United States Patent [19]

Kurosaki

[11] Patent Number: 5,458,038

[45] Date of Patent: Oct. 17, 1995

[54] FOOT PEDAL FOR DRUM SET

[75] Inventor: Makoto Kurosaki, Hamamatsu, Japan

[73] Assignee: Yamaha Corporation, Hamamatsu, Japan

[21] Appl. No.: 232,572

[22] Filed: Apr. 21, 1994

Related U.S. Application Data

[63] Continuation of Ser. No. 881,716, May 12, 1992, abandoned.

[30] Foreign Application Priority Data

Jun. 27, 1991 [JP] Japan ..... 3-157192

[51] Int. Cl.[6] ..... G10D 13/02

[52] U.S. Cl. ..... 84/422.1

[58] Field of Search ..... 84/422.1, 422.2, 84/422.3, 422.4

[56] References Cited

U.S. PATENT DOCUMENTS

| | | | |
|---|---|---|---|
| 922,706 | 5/1909 | Ludwig | 84/422.1 |
| 1,570,167 | 1/1926 | Mortensen | 84/422.1 |
| 3,563,129 | 2/1971 | Cantrell | 84/422.1 |
| 4,873,910 | 10/1989 | Kurosaki | 84/422.1 |

OTHER PUBLICATIONS

The American Heritage Dictionary, Houghton Mifflin Co., pp. 446 & 616.

*Primary Examiner*—Kristine L. Kincaid

*Assistant Examiner*—Cassandra Spyrou

*Attorney, Agent, or Firm*—Spensley Horn Jubas & Lubitz

[57] ABSTRACT

A foot pedal, particularly as used for the bass drum of a drum set, is fundamentally constructed of a heel member, a foot board, a beater, a frame member and a base plate. The heel member supports one edge portion of the foot board so that the foot board can freely rotate about the supporting point. In response to operation of the foot board by the performer, the beater is moved to beat the drum head of bass drum, so that the bass drum sounds are produced. The beater is supported by the frame member so that it can freely rotate about the supporting point. The frame member has a vertical portion which extends along with the rotation direction of the foot board. An edge portion of the base plate is fixed to the heel member, while an opposite edge portion is fixed to the vertical portion of the frame member by a connecting mechanism, so that the base plate is assembled with the heel member and frame member in the predetermined positional relationship. The connecting mechanism provides plural fixing portions by which the base plate is connected to the vertical portion of the frame member in a plane which is approximately perpendicular to the base plate. Preferably, the plural fixing portions are provided by holes formed through the vertical portion of the frame member and at least one of them having an elliptical shape by which the fixing position can be varied.

2 Claims, 5 Drawing Sheets

FOOT PEDAL FOR DRUM SET

This is a continuation of application Ser. No. 07/881,716, filed May 12, 1992, now abandoned.

BACKGROUND OF THE INVENTION

1. Field of the Invention

The present invention relates to a foot pedal which is used for the bass drum in a drum set.

2. Prior Art

A foot pedal, used for the bass drum of a drum set, is designed to rotate a beater in accordance with foot pressure applied to a foot board thereof so that the drum head of the bass drum is beaten by the beater.

In order to stabilize the operation of the foot pedal, the conventional foot pedal is constructed in accordance with one of three construction countermeasures described as follows.

(1) In a first countermeasure, as illustrated in FIG. 1, a connection rod 7 interconnects a frame member 4, which rotatably supports a shaft axis 3 of a beater member 2, to a heel member 6, which supports a back edge portion of a foot board 5.

(2) In a second countermeasure, as illustrated in FIG. 1, a base plate 8 is provided between the frame member 4 the and heel member 6 so that the frame member 4 is attached to the base plate 8 by screws 9.

(3) In a third countermeasure, the above-mentioned first and second countermeasures are combined together, as disclosed in U.S. Pat. No. 4,538,499.

In addition to the fast changes of a music performance these days, the performance technique using the foot pedal must be substantially changed. In making such changes, however, a conventional foot pedal, constructed in accordance with the above-mentioned countermeasures, cannot respond to such hard operations well. In short, the conventional foot pedal suffers from the following drawbacks, in the case of each of the countermeasures.

(a) In the foot pedal constructed in accordance with the first countermeasure, when the foot board 5 is stepped on during the performance, the heel member 6 may be somewhat elevated. In this countermeasure wherein the frame member 4 and heel member 6 are connected together by the connection rod 7 only, it is difficult to maintain the positional relationship between them. Therefore, it is impossible to stabilize the tone-generation timing and beating strength in response to the step-on operation of the foot board 5. In short, such countermeasure may affect the performability of the music.

(b) The foot pedal, constructed in accordance with the second countermeasure, may employ the so-called double-sided single- point-supporting-structure by which the frame member 4 is attached to the base plate 8. Due to such structure, the frame member 4 may be rotated with the base plate 8 about the supporting point, which is an unstable construction. In general, the bass drum is disposed within the drum set in an inclined manner. For this reason, the construction of this countermeasure may allow the base plate 8 to be bent during the operation of the foot pedal.

(c) In the third countermeasure, which is the combination of the first and second countermeasures, even the connection rod 7 cannot reinforce the strength of the connection between the frame member 4 and base plate 8 effectively . With such relatively weak reinforcement, the third countermeasure requires an increase in the number of the members thereof required. As described before, since the bass drum is disposed within the drum set in an inclined manner, there is a possibility that the base plate 8 will be subjected to the bending deformation.

SUMMARY OF THE INVENTION

It is accordingly a primary object of the present invention to provide a foot pedal for a drum set which can improve the stability thereof during a performance operation.

According to the fundamental construction of the present invention, a foot pedal for a drum set is comprised of a foot board a of which one edge portion is supported by a heel member in free-rotation manner; a beater which beats the drum head in response to step-on operation of the foot board; a frame member which supports the beater in the free-rotation manner and which has a vertical portion; and a base plate having one edge portion fixed to the heel member and an opposite edge portion fixed to the vertical portion of the frame member by means of a connecting means, whereby the base plate is assembled with the heel member and frame member in a predetermined positional relationship.

In a first aspect of the present invention, the connecting means provides plural fixing portions by which the base plate is connected to the vertical portion of the frame member in a plane which is approximately perpendicular to the base plate. Thus, it is possible to stabilize the positional relationship between the frame member and heel member, which may improve the performability of the foot pedal.

In a second aspect of the present invention, the connecting means is further modified such that at least one of the foregoing plural fixing portions can have the fixing position thereof varied. By adjusting the fixing position of at least one fixing portion, it is possible to match the inclined angle of the bass drum with the angle to be formed between the frame member and the base plate. Thus, there is no chance of the base plate being bent.

BRIEF DESCRIPTION OF THE DRAWINGS

Further objects and advantages of the present invention will be apparent from the following description, with reference being had to the accompanying drawings wherein the preferred embodiments of the present invention are clearly shown.

In the drawings.

DESCRIPTION OF THE PREFERRED EMBODIMENTS

Next, description will be given of the preferred embodiments of the present invention.

[A] First Embodiment

Figure 1:
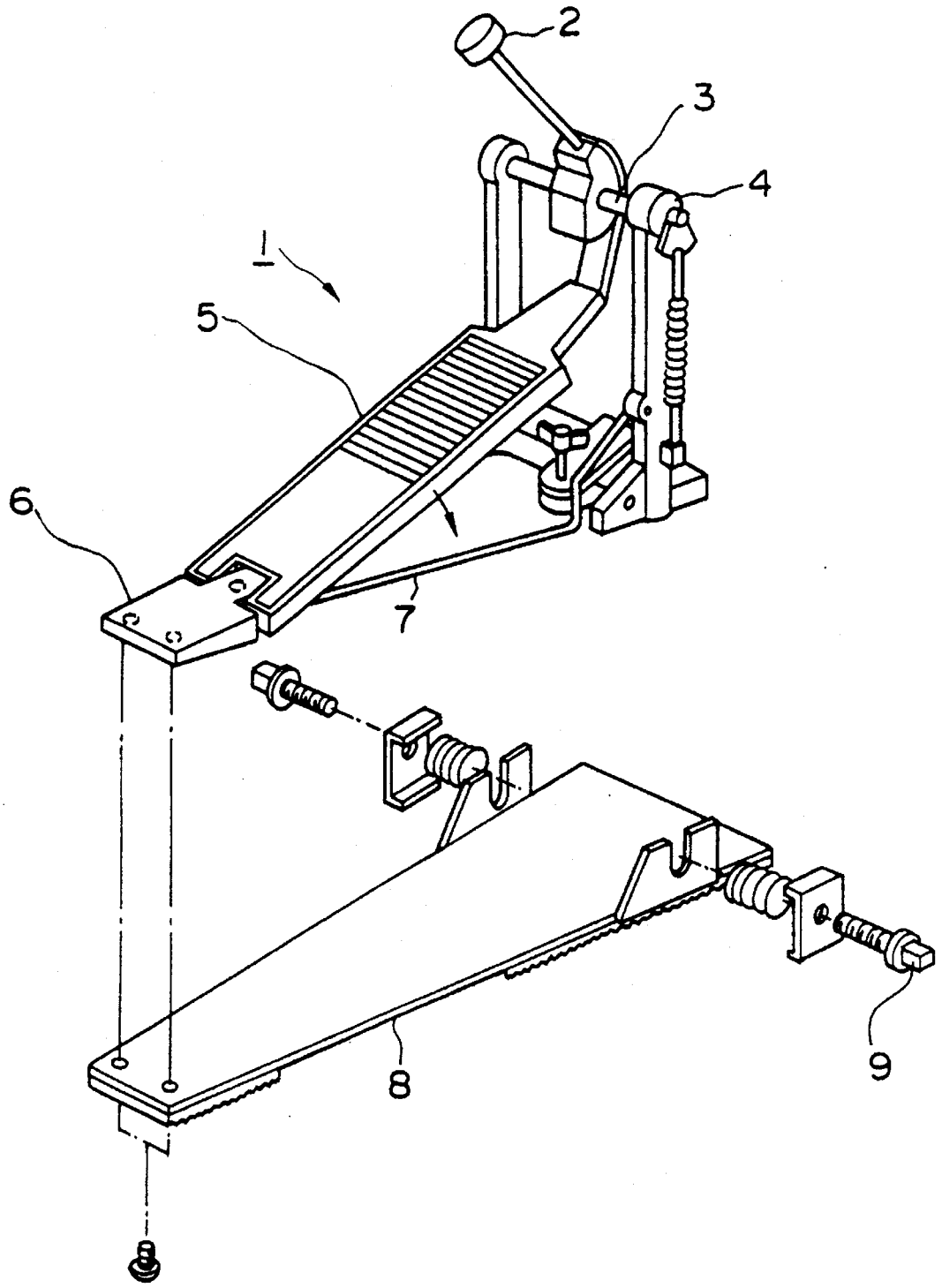
FIG. 1 PRIOR ART
FIG. 1 is an upper right perspective view illustrating the construction of a conventional foot pedal for a drum set.
Figure 2:
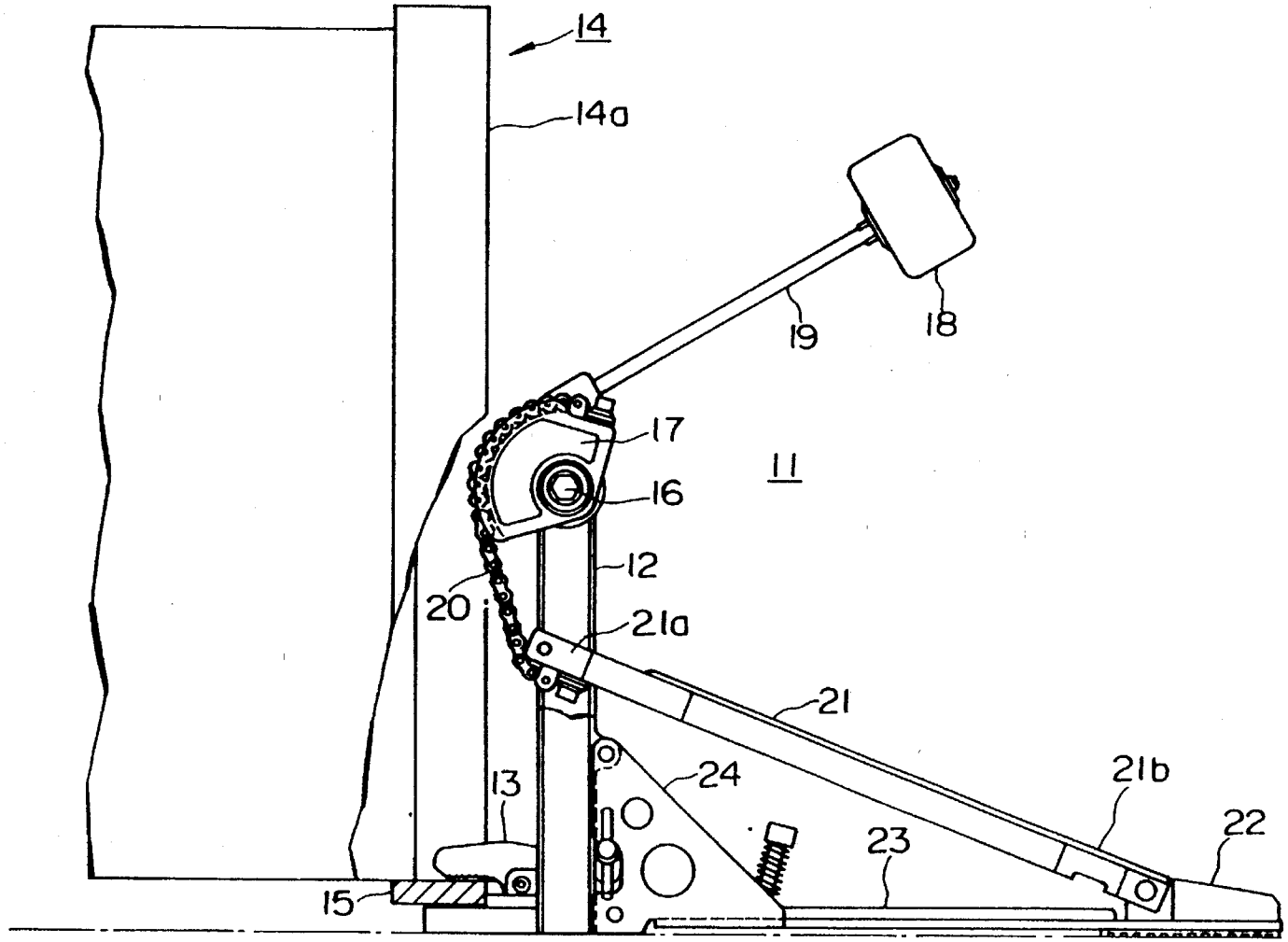
FIG. 2 is a side view, partly in section illustrating the construction of a foot pedal for a drum set according to a first embodiment of the present invention.

FIG. 2 is a sectional view illustrating the construction of a foot pedal 11 according to the first embodiment of the present invention. Herein, 12 designates a frame member, and 13 designates a hoop clamp which is attached to a base-edge portion of the frame member 12. In addition, a clamping frame 15 is sandwiched between the hoop clamp 13 and base-edge portion of the frame member 12, so that a foot board 21 is attached to a bass drum 14.

Further, a rocker 17 is coupled to an upper-edge portion of the frame member 12 for rotation about an axis 16. A beater 18 is connected to the locker 17 via a beater rod 19. In addition, a chain 20 is connected to a front-edge portion 21*a* of a foot board 21. This front-edge portion 21*a* of the foot board 21 is raised up by a return spring (not shown), so that the foot board 21 is disposed at a predetermined angle as shown in FIG. 2. On the other hand, a back-edge portion 21*b* of the foot board 21 is connected to a heel member 22 such that it can freely rotate about the connecting point. Furthermore, 23 designates a base plate which interconnects the foregoing frame member 12 with the heel member 22.

Figure 3:
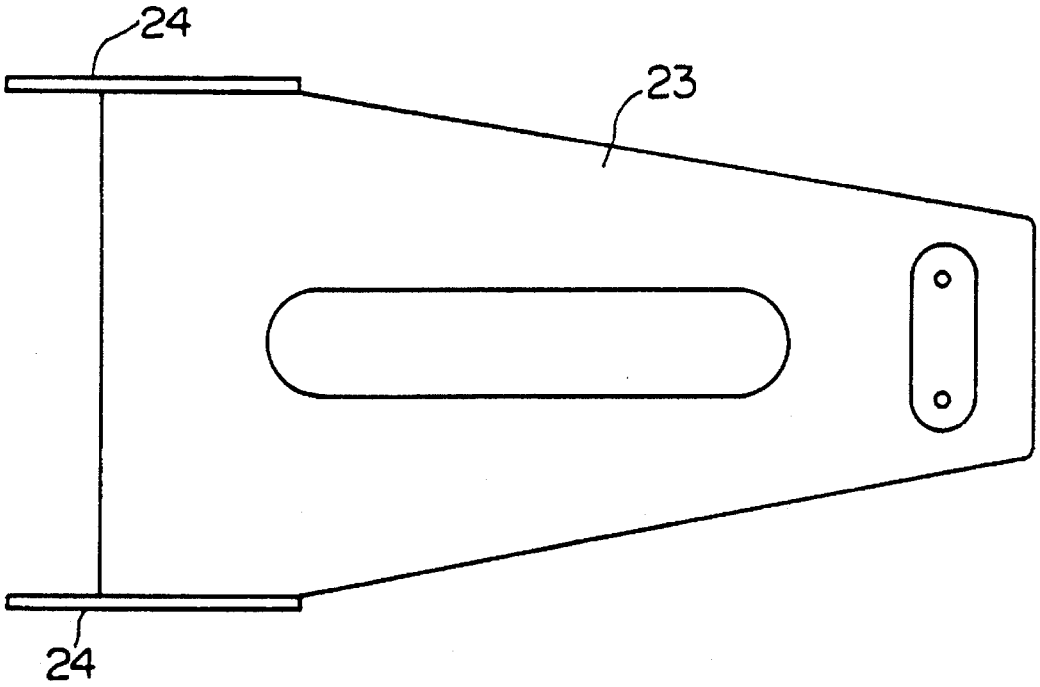
FIG. 3 is a plan view illustrating a base plate of the foot pedal shown in FIG. 2.
Figure 4:
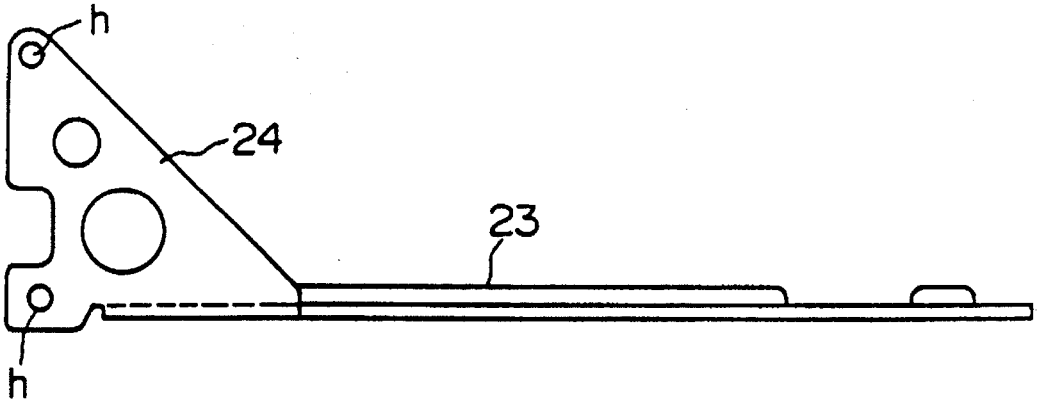
FIG. 4 is a side view of the base plate of FIG. 3.

The reference number 24 designates side boards, each having a triangular shape, which support the frame member 12 and base plate 23 at three points. As shown in FIG. 3, the side boards 24 are formed by bending opposite side portions of the base plate 23 in a vertical direction. As shown in FIG. 4, two frame-fixing holes "h" are provided at the predetermined positions within the side board 24. Using the holes "h", the frame member 12 the and base plate 23 are fastened by bolts and are fixed together. In this case, screw holes (not shown) are formed in the frame member 12 so as to tighten the frame member 12 and base plate 23 to the side board 24 with the bolts. As described above, the frame member 12 is fixed to the base plate 23 by the so-called three-point-supporting-structure, which can stabilize the positional relationship between them. Therefore, even in the hard operations applied to the foot pedal, it is possible to stabilize the mechanical action of the foot pedal, which will improve the performability.

[B] Second Embodiment

Figure 5:
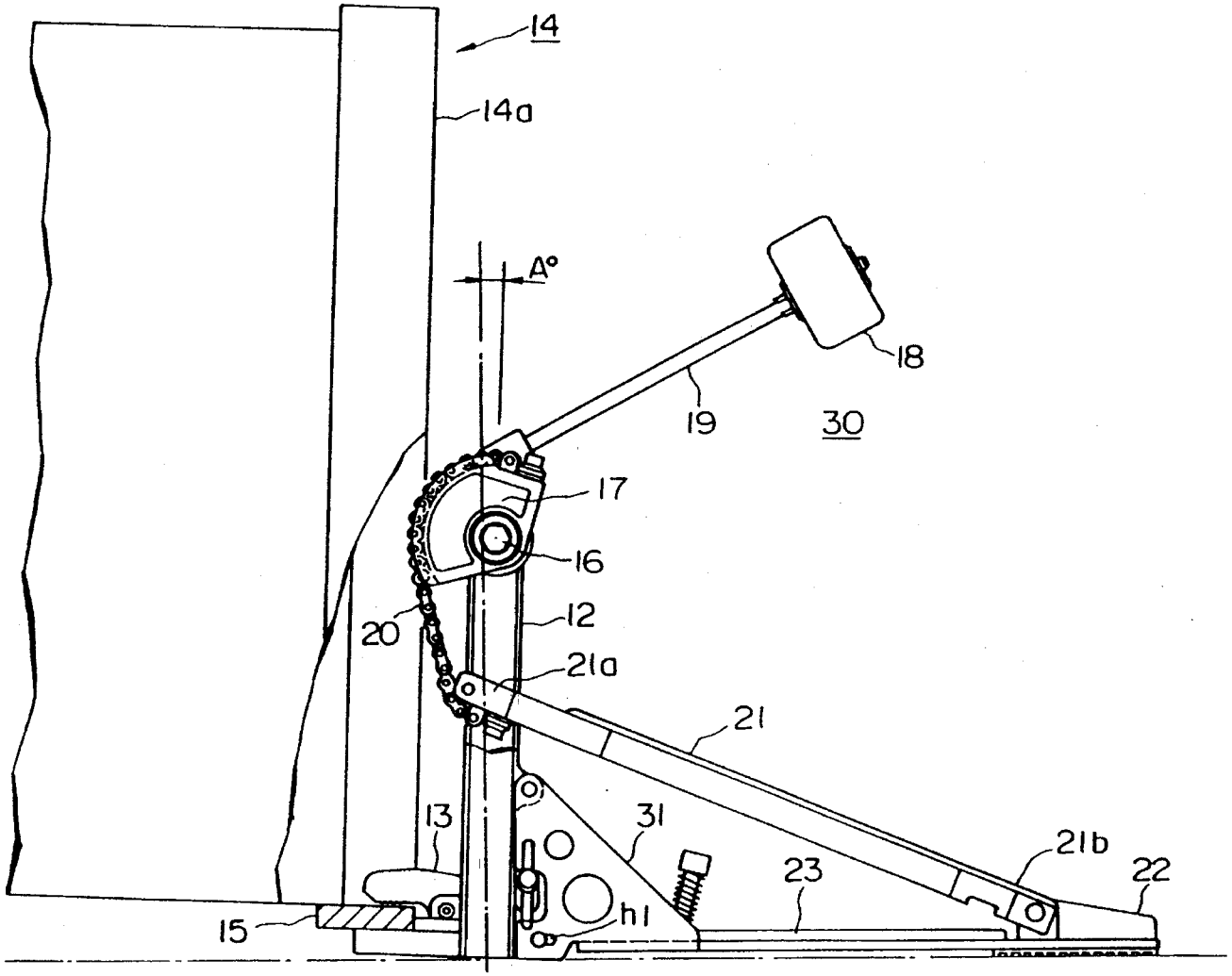
FIG. 5 is a side view, partly in section illustrating the construction of a foot pedal for a set according to a second embodiment of the present invention.
Figure 6:
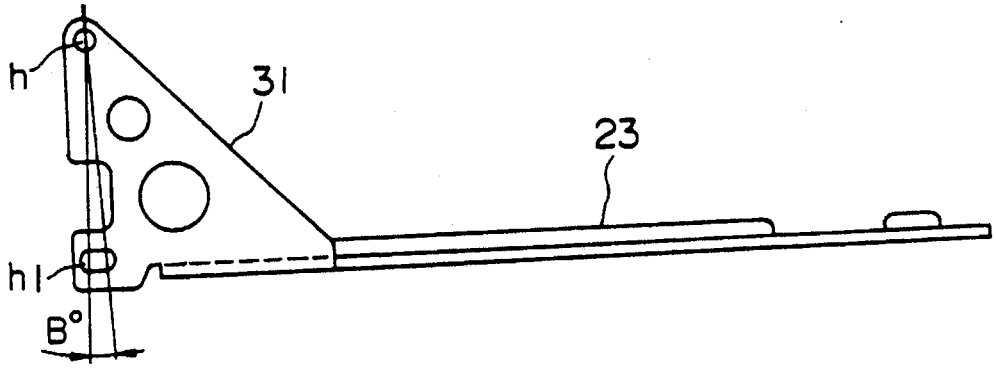
FIG. 6 is a side view illustrating a base plate of the foot pedal shown in FIG. 5.

Next, description will be given of a foot pedal 30 according to the second embodiment of the present invention with reference to FIG. 5. The second embodiment is basically identical to the foregoing first embodiment, with the only difference between them lying in the shape of a hole "h1" which is located at the lower edge portion of a side board 31. More specifically, and as shown in FIG. 6, the hole "h1" has an elliptical shape with the elongated centerline thereof lying in the horizontal direction. Due to the elliptical shape of the hole "h1", it is possible to match the inclined angle A° of the bass drum 14 with are the angle B° to be formed between the frame member 12 and base plate 23 (see FIG. 6). Therefore, such construction can offer a higher applicability with respect to the bass drum 14 which is generally disposed within the drum set in an inclined manner. If the connection between the frame member and base plate does not match the inclination of the bass drum, the base plate 23 is subjected to the bending deformation, which will affect the performability.

Figure 7:
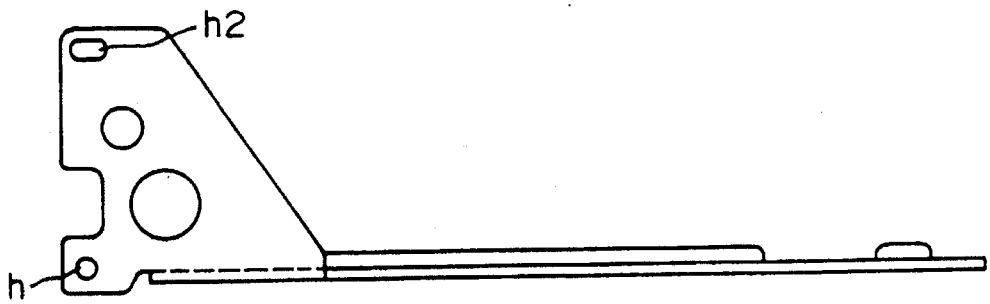
FIGS. 7 and 8 are side views respectively illustrating modified examples of the base plate used in the second embodiment.
Figure 8:
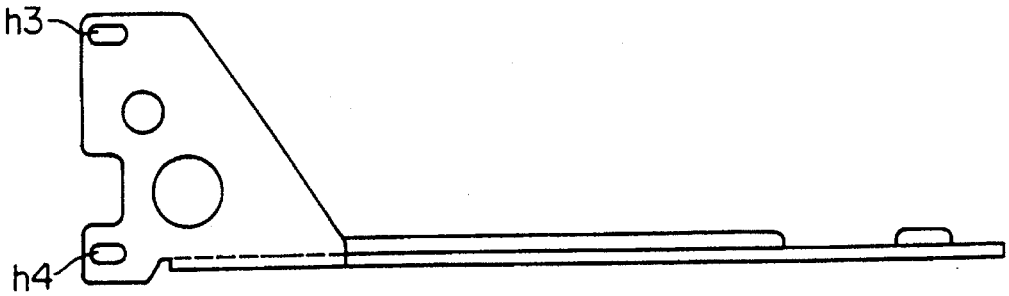

Meanwhile, it is not necessary to form the lower hole h1, extending through the left-side side board 31, in the elliptical shape. Therefore, it is possible to modify the second embodiment such that, as shown in FIG. 7, an upper hole h2 is formed with the elliptical shape. Or, both of upper and lower holes h3, h4 are formed in the elliptical shape as shown with FIG. 8.

Incidentally, the constructions of the foregoing embodiments are both described in terms of a foot pedal, having a single beater, for the drum set. However, the present invention is not limited to such application. Of course, the fundamental construction of the present invention can be applied to other pedals for the drum sets, such as the twin-beater-type pedal and the side pedal.

Lastly, this invention may be practiced or embodied in still other ways without departing from the spirit or essential character thereof as described heretofore. For example, the foregoing vertical portion of the frame member need not extend along with the rotation direction of the foot board. Therefore, the preferred embodiments described herein are illustrative and not restrictive, the scope of the invention being indicated by the appended claims and all variations which come within the meaning of the claims are intended to be embraced therein.

What is claimed is:

1. A foot pedal for a drum set comprising:

a foot board having an edge portion supported by a heel member for free rotation relative thereto;

a beater for beating a drum head of a base drum of the drum set in response to operation of said foot board;

a frame member supporting said beater for free rotation relative thereto, said frame member having a vertical portion; and a base plate having a first edge portion which is fixed to said heel member and a second edge portion opposite the first edge portion which is attached to the vertical portion of said frame member by means of a connecting means, so that said base plate is assembled with said heel member and said frame member in a predetermined positional relationship;

wherein said connecting means includes a connecting member having a plurality of spaced-apart fixing portions at a side edge of the base plate adjacent the second edge portion of the base plate at each of which said base plate is connected to the vertical portion of said frame member in a plane which is approximately perpendicular to said base plate, the connecting member extending along and being attached to a portion of the side edge of the base plate spaced-apart from the vertical portion of the frame member and comprising a side board extending upwardly from the side edge of the base plate adjacent the second edge portion of the base plate, and the fixing portions comprising holes formed at predetermined positions within said side board, said connecting means connecting said frame member with said base plate via said holes within the side board, the side board being triangular in shape and having adjacent first and second side edges, the side board being attached to the side edge of the base plate at the first side edge thereof at a location spaced from said fixing portions and the holes being formed in the side board adjacent the second side edge thereof.

2. A foot pedal for a drum set comprising:

a foot board having an edge portion supported by a heel member for free rotation relative thereto;

a beater for beating a drum head of a base drum of the drum set in response to operation of said foot board;

a frame member supporting said beater for free rotation relative thereto, said frame member having a vertical portion; and a base plate having a first edge portion which is fixed to said heel member and a second edge portion opposite the first edge portion which is attached to the vertical portion of said frame member by means of a connecting means, so that said base plate is assembled with said heel member and said frame member in a predetermined positional relationship;

wherein said connecting means provides a plurality of spaced-apart fixing portions at a side edge of the base plate adjacent the second edge portion of the base plate at each of which said base plate is connected to the vertical portion of said frame member in a plane which is approximately perpendicular to said base plate, and comprises means for selectively adjusting the angular orientation of the vertical portion of the frame member relative to the base plate.

* * * * *